United States Patent [19]

Barauke

[11] Patent Number: 4,519,199

[45] Date of Patent: May 28, 1985

[54] DEVICE FOR INTERRUPTING THE FEED OF A ROVING TO THE DRAWING FRAMES OF A SPINNING MACHINE

[75] Inventor: Norbert Barauke, Donzdorf, Fed. Rep. of Germany

[73] Assignee: Spindelfabrik Sussen, Schurr, Stahlecker & Grill GmbH, Fed. Rep. of Germany

[21] Appl. No.: 367,999

[22] Filed: Apr. 13, 1982

[30] Foreign Application Priority Data

May 15, 1981 [DE] Fed. Rep. of Germany ..... 3119408

[51] Int. Cl.[3] ..... D01H 13/16; D01H 13/18; D01H 5/66

[52] U.S. Cl. ..... 57/87; 19/263; 57/81; 57/304; 57/305

[58] Field of Search ..... 57/80, 81, 84, 86, 87, 57/304, 305; 19/263

[56] References Cited

U.S. PATENT DOCUMENTS

| | | | |
|---|---|---|---|
| 3,073,105 | 1/1963 | Jacobi et al. | 19/263 X |
| 3,751,896 | 8/1973 | Ford | 57/87 |
| 3,885,272 | 5/1975 | Marzoli | 19/263 X |
| 4,030,281 | 6/1977 | Schopper et al. | 57/87 |
| 4,110,963 | 9/1978 | Plate et al. | 57/87 X |
| 4,175,371 | 11/1979 | Gasser et al. | 19/263 X |
| 4,213,290 | 7/1980 | Kupper | 57/87 X |
| 4,280,321 | 7/1981 | Marzoli | 57/87 X |
| 4,375,149 | 3/1983 | Hartmannsgruber | 57/81 |

*Primary Examiner*—John Petrakes

*Attorney, Agent, or Firm*—Craig and Burns

[57] ABSTRACT

A device for interrupting the feed of a roving to drawing frames of a thread spinning machine of the type wherein each drawing frame comprises a plurality of pairs of upper and lower drawing rollers, of which the lower drawing roller, located on a roving in-feed side of the drawing frame, is provided with a clamping segment for interrupting the roving feed in a released position thereof in response to a broken-end detector, which monitors the presence of a spun thread, is improved by the provision of a suction device, associated with the drawing rollers on a thread formation side of the drawing frames, for collecting rovings present in a drawing frame when the roving feed thereto is interrupted. In accordance with a perferred embodiment, the suction device comprises suction tubes which are mounted for movement away from the drawing rollers and lockable in respective operating and nonoperating positions. According to another feature, the broken-end detector is mounted to an end of the suction tubes which face a drawing roller, which is downstream-most in a direction of the roving feed.

9 Claims, 6 Drawing Figures

DEVICE FOR INTERRUPTING THE FEED OF A ROVING TO THE DRAWING FRAMES OF A SPINNING MACHINE

BACKGROUND AND SUMMARY OF THE INVENTION

The invention relates to a device for interrupting the feed of a roving to the drawing frames of a spinning machine, wherein each drawing frame comprises a plurality of upper and lower drawing rollers arranged pairwise, of which a lower drawing roller is provided with a clamping segment, at its roving feed side, which is held against movement with the lower drawing roller by a locking device that is triggerable by means of a broken-end detector which monitors the moving thread. The locking device, which automatically drops into its locking position, is provided with an electric drive, said drive being controllable by the broken-end detector and being energizable for a preset time interval, said drive acting to displace the locking device into an unlocking position. Such an arrangement is described in commonly assigned, pending U.S. application Ser. No. 331,281, filed Dec. 16, 1981; now U.S. Pat. No. 4,432,195.

In such an arrangement, the clamping segment, during normal operation, is held by the locking device in a position which permits unimpeded feeding of the roving between the drawing rollers. In the event of a thread break, a broken-end detector effects a temporary energization of an electric drive mounted on the locking device, so that the clamping segment is unlocked and rotated up to a stop disposed between the two drawing rollers on the roving-feed side, whereby it clamps the roving against the upper, non-driven drawing roller and lifts the latter simultaneously away from the lower, driven drawing roller. Since the electric drive is energized for only a preset interval, after this time has elapsed, the locking device automatically is permitted to resume its original position, i.e., the locked position. In order to initiate roving feed, the clamping segment need only be turned back into its original position, in which it is engaged by the locking device. No further intervention by the operator is required. The device ensures reliable and rapid interruption of roving feed after a thread break and, as a rule, prevents the formation of fiber laps on the drawing rollers (i.e., fibers improperly wound around the drawing rollers). The goal of the present invention is to avoid formation of fiber laps even more reliably. This goal is achieved, in accordance with preferred embodiments of the present invention, by virtue of the fact that suction devices are associated with the drawing rollers on the thread-forming side.

Since the forward pairs of drawing rollers of the arrangement of above noted Ser. No. 331,281 continue rotating independently of the energization of the device for interrupting roving feed, the fibers which are still in this area, after fiber feed is interrupted, are carried further without, however, being spun into a thread. The device, according to the present invention has, therefore, been designed so as to ensure that these fibers, located between the clamping point of the roving and the thread-break location, will likewise not be transported away in an uncontrolled fashion, but will instead enter the suction device. The danger of lap formation on the drawing rollers is further reduced by this measure. The present invention also has the advantage that the fibers which enter the suction device are not wasted and can be reused.

In order to facilitate the removal of fiber laps which do manage to form on the drawing rollers, in another aspect of the preferred embodiment of the invention, accessibility to the drawing rollers, despite the provision of the suction device, is ensured, since the suction devices can be moved away from the drawing rollers and are, preferably, lockable in their operating positions and nonoperating positions. Consequently, the position of the suction device can be modified rapidly and reliably to suite the conditions of the moment, since additional unlocking and locking of the suction device is eliminated.

In an especially simple embodiment, each suction device is designed as a suction tube, mounted, by its end away from the drawing rollers, pivotably on the drawing frame or machine frame, and having a connection for a hose connected or connectable to a vacuum source.

In accordance with another feature of the preferred embodiment of the invention, provision is made for the suction tube, made of an elastically flexible material, to be guided as it swivels away in a guide eye within a guide slot, the eye being arranged on the drawing frame or machine frame, the width of said slot at the locking positions corresponding to the outside diameter of the suction tube, and being narrower in the other areas relative to the outside diameter of the suction tube. This results in an especially sturdy and economical device for locking the suction device.

In accordance with yet another advantageous feature of the disclosed embodiment, the broken-end detector is provided with a feeler resting against the moving thread, said feeler being in the form of a pivotably mounted flat plate. A thread feeler of this kind is very light, since it is made, for example, of coated plastic. It can have a strikingly bright color, and thus serve as a signal, which can be seen from a distance, indicating that a thread break must be corrected.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENTS

Figures 1, 6:
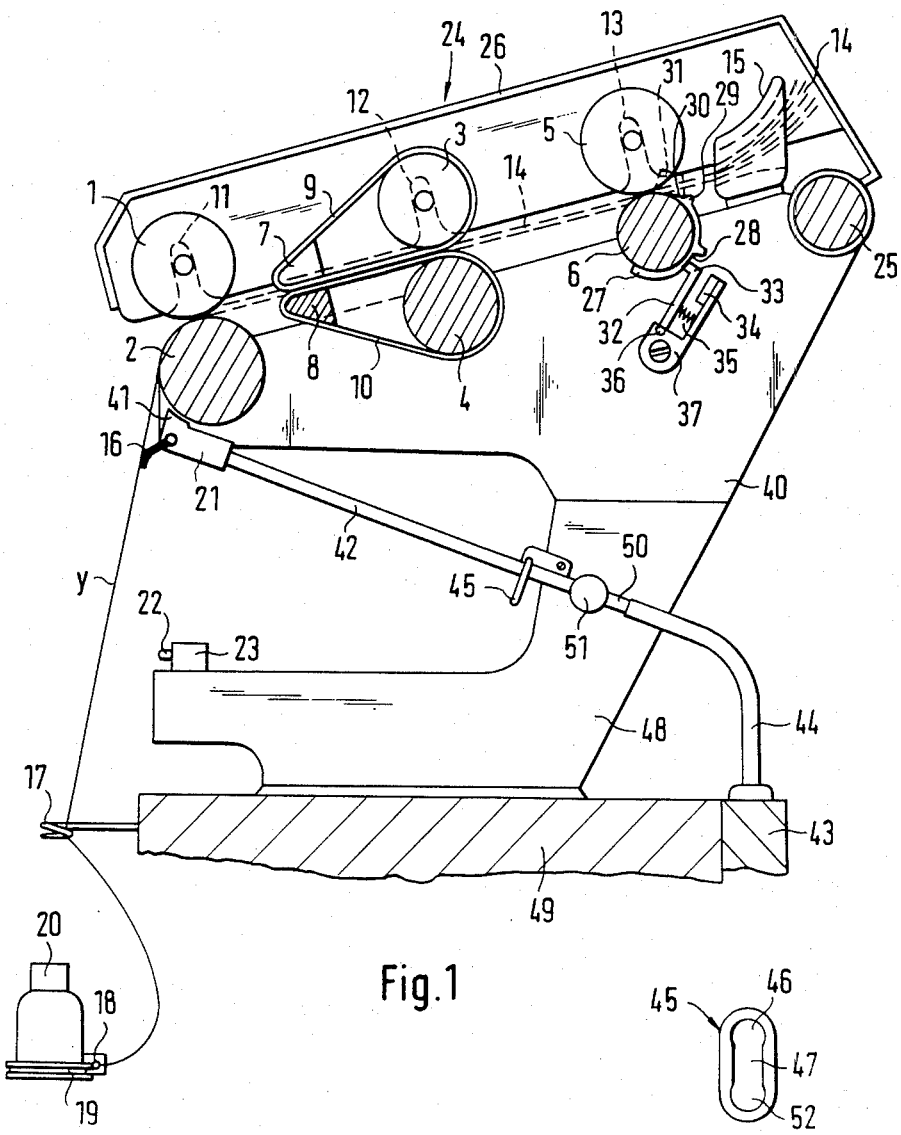
FIG. 1 shows a side elevation of a device according to the present invention on a drawing frame of a ring-spinning machine during spinning.
FIG. 6 is a front elevation of a guide eye shown in FIGS. 1 to 3.

Drawing frame 24, shown as a sample embodiment, is a component of a spinning machine, which has a plurality of spinning units disposed side by side. Each of these spinning units has associated with it such a drawing frame 24, said frame having two forward drawing rollers 1 and 2, two middle drawing rollers 3 and 4, and two rear drawing rollers 5 and 6, said rollers being mounted opposite one another in pairs. Middle drawing rollers 3 and 4 are additionally equipped with belts 9 and 10, guided by belt guides 7 and 8.

Upper drawing rollers 1, 3 and 5 are mounted displaceably by means of spring elements in guides 11, 12 and 13 of a common arm 26, said elements urging them toward lower drawing rollers 2, 4 and 6. Lower drawing rollers 2, 4 and 6 are designed in the form of cylinders, running along the length of the machine, composed of several sections. Upper drawing rollers 1, 3 and 5, preferably, each are mounted to rotate about a common axis with the corresponding drawing rollers on the adjacent spinning unit, i.e., upper drawing rollers 1, 3 and 5 are each combined pairwise on a common shaft in an arm 26. Arm 26 is pivotable about an axis 25, which is parallel to the roller axes, so that the drawing frame 24 can be opened.

A roving 14 is fed to drawing frame 24 through a feed funnel 15, said roving being stretched by virtue of the fact that drawing rollers 3 and 4 revolve at a higher rotational speed than drawing rollers 5 and 6 on the feed side, and further by virtue of the fact that drawing rollers 1 and 2 rotate more rapidly than drawing rollers 3 and 4. The roving which is stretched after leaving drawing rollers 1 and 2 is spun to form a yarn Y and wound on a bobbin 20, whereby yarn Y is guided through a thread guide eye 17 and a traveller 18, said traveller being disposed on a ring 19 surrounding bobbin 20. Drawing rollers 2, 4 and 6, designed as continuous cylinders, are driven in known fashion in the machine head.

Drawing frame 24 is equipped with a device for interrupting the feed of roving 14, said device being triggered as a function of a break in yarn Y. This device comprises a clamping segment 27, made as a plastic part forming part of a ring, said plastic part being clipped with clamping tension on that side of drawing roller 6 which faces the feed side, i.e., feed funnel 15. It encompasses approximately more than half the circumference of drawing roller 6, whereby, in the operating position shown in FIG. 1, it is located opposite upper drawing roller 5 in such fashion that the transport of roving 14 is not impeded.

Forward edge 30, looking in the direction of rotation of drawing roller 6, is designed as a wedge, bounded by a radially directed stop 29. Tabs 31, directed laterally and radially, are provided in the vicinity of edge 30, said tabs being opposite the ends of upper drawing roller 5 and forming a protection against axial displacement. One of the two tabs 31 is simultaneously designed to serve as a gripping tab extending axially with respect to drawing roller 6.

If the clamping segment is not secured in the operating position shown in FIG. 1, it is entrained by drawing roller 6 in the rotational direction, so that the wedge-shaped edge 30 is inserted, from below, between drawing roller 5 and drawing roller 6, whereby the upper drawing roller 5 can be lifted slightly. The entrainment movement of the clamping segment 27 is then limited by stop 29, which runs on upper drawing roller 5. Roving 14 is then clamped between upper drawing roller 5 and wedge-shaped edge 30, whereby the drive to upper drawing roller 5, and hence the transport of roving 14, are interrupted simultaneously by the lifting of upper drawing roller 5 away from lower drawing roller 6.

Advantageously, and in a manner not shown in greater detail, a guide table is provided between drawing roller pair 3 and 4 and drawing roller pair 5 and 6, said table supporting roving 14 in the area between drawing roller pairs 3-4 and 5-6.

To secure the operating position of clamping segment 27 shown in FIG. 1, a locking lever 32 is provided, said lever being pivotable about a shaft 36 running parallel to drawing roller 6, and engaging an axial groove 28 in clamping segment 27 with a nose 33, said nose running radially with respect to the axis of drawing roller 6.

Locking lever 32 runs approximately tangentially to the limiting edge of groove 28, so that no torque is exerted on nose 33, which projects at right angles from locking lever 32. The locking force acts only in the lengthwise direction of locking lever 32. Shaft 36 is mounted on a holder 37 screwed to a roller stand 40. Holder 37, with an arm, constitutes a thrust bearing for a compression spring 35, whose other end abuts locking lever 32, so that said lever has its nose 33 forced into groove 28 by compression spring 35.

The arm of holder 37 also bears an electromagnet 34, associated with the free end of locking lever 32, said lever being made of a magnetizable material or being provided, at least in the vicinity of the nose, with a magnetizable insert, i.e., one which responds to magnetic forces.

Figure 2:
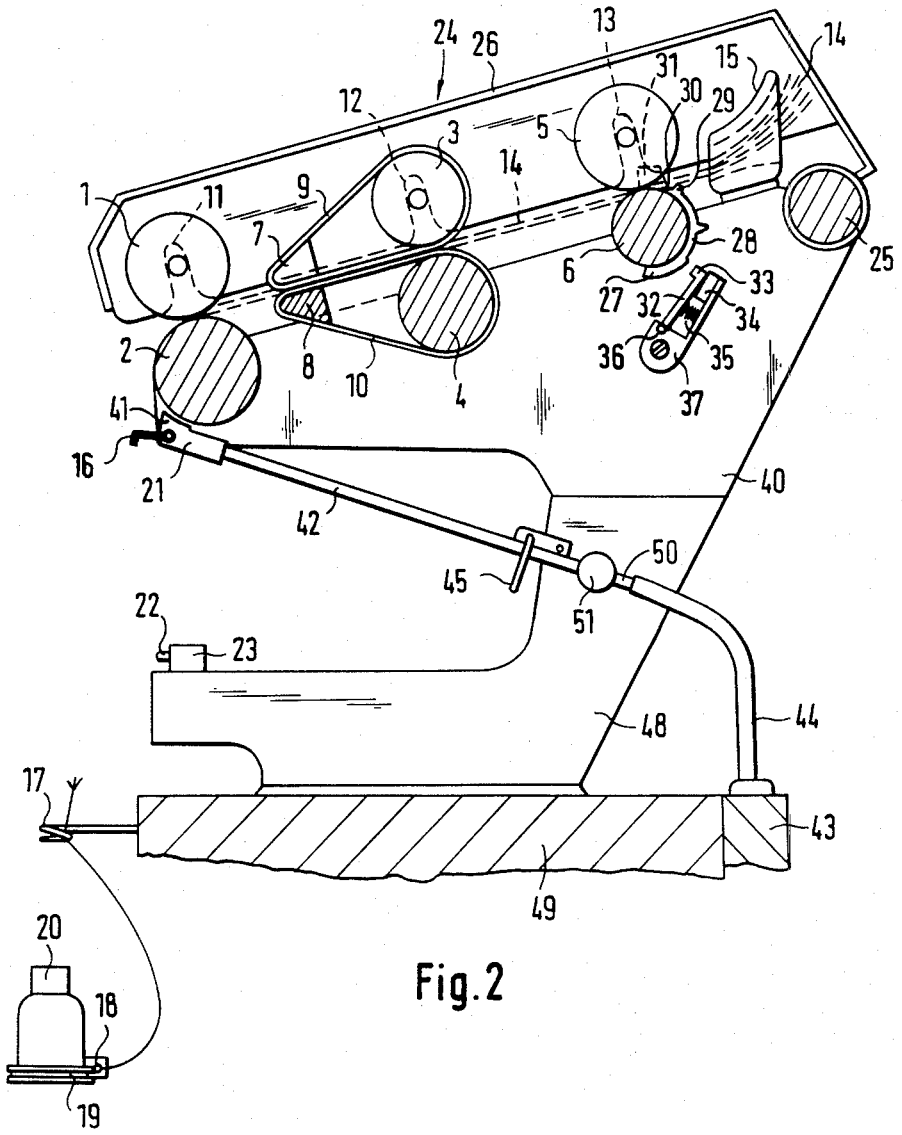
FIG. 2 is a side elevation similar to FIG. 1, but during a thread break or immediately thereafter.
Figure 3:
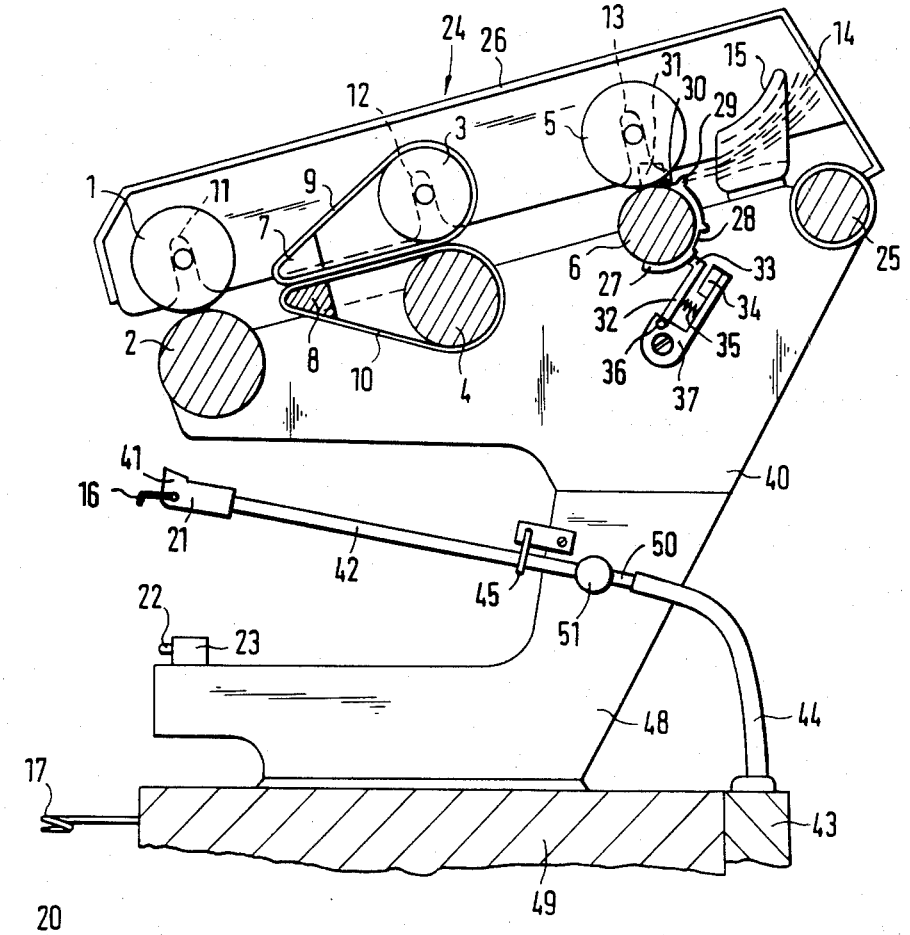
FIG. 3 is a side elevation similar to FIG. 1, but after a thread break, and with the suction tube swivelled away.

In the event of a yarn break, magnet 34 is energized briefly, pulling nose 33 of locking lever 32 out of groove 28, so that clamping segment 27 is entrained by roller 6 in its rotational direction, effecting interruption of the feed of roving 14 in the manner described (FIG. 2). The excitation of magnet 34 is maintained only briefly, so that, after unlocking, locking lever 32 is returned by compression spring 35 to its locking position (FIG. 3).

To resume feed of roving 14, it is sufficient for the operator to rotate clamping segment 27 backward by gripping grip tab 31 and turning it backward against the direction of rotation of drawing roller 6 until nose 33 of locking lever 32 automatically drops into groove 28 under the influence of compression spring 35. This can be performed very easily by hand by the operator. Up to this point, the structure and operation of the illustrated embodiment conforms to that of said Ser. No. 331,281.

Brief excitation of magnet 34 is monitored by a broken-end detector 21, which, unlike that of Ser. No. 331,281, is disposed on a suction device 41 in the vicinity of the forwardmost drawing roller pair 1, 2. In the embodiment shown, broken-end detector 21 is designed as an electric switch, having a feeler 16 resting against yarn Y. Instead of a broken-end detector 21 with a feeler 16 of this type, zero-contact broken-end detectors can also be used.

The suction device 41 mentioned above serves to catch any fibers which are still located in the drawing frame 24, in the transport direction, beyond rearmost drawing rollers 5, 6, after roving feed is interrupted. Suction device 41 is disposed along with broken-end detector 21 in the vicinity of the forward, lower drawing roller 2. In the embodiment, it is designed as a suction tube 42, said tube being pivotably mounted to a shaft 51 in the vicinity of its end 50, said shaft being disposed parallel to drawing rollers 1, 2, 3, 4, 5, 6 on drawing frame 48.

Suction tube 42 consists of a slightly elastic, flexible material, e.g., plastic, but is resistant to bending and is guided in a guide eye 45 mounted on drawing frame 48 (see FIG. 6). Guide eye 45 is in the form of a guide slot 47, expanded at its end points 46, 52 to conform to the outside diameter of suction tube 42, and made narrower than the outside diameter of suction tube 42 threbetween. Suction tube 42 is connected to its end 50 with a tube 44 which leads to a vacuum source 43 that is associated with machine frame 49, said source being a component of the machine.

In the event of a thread break, the fibers which are located in the transport direction beyond the nip of rear drawing rollers 5 and 6, following interruption of roving feed, are transported by the forward and middle drawing rollers 1, 2, 3, 4, which continue to be driven, into the area upstream of the forward drawing rollers 1 and 2. Here they are trapped by suction device 41 and transported through suction tube 42 and tube 44 in the direction of vacuum source 43, where they are collected in a screen, not shown. Suction tube 42 is engaged in guide slot 47 to guide eye 45 in position 46. In this way, the danger of lap formation on forward drawing rollers 1 and 2, which has already been considerably reduced by the interruption of roving feed, by contrast with conventional drawing frames, can be reduced even further.

Nevertheless, should any fiber laps form on the already endangered forward, lower drawing roller 2, said roller can be made readily accessible by swinging suction tube 42 away by rotating it about shaft 51. Suction tube 42 is guided in guide eye 45 as it swivels, whereby it is slightly compressed as it passes through the narrow point in elongated slot 47, and expands again as it snaps into position 52. In this way, suction device 41 is firmly held in both locking positions 46 and 52. Shaft 51 is so disposed that broken-end detector 21 and its feeler 16 lie along the travel path of the yarn even when they are in the nonoperating position. Even if the operator should forget, after clearing up a lap, to bring the suction device 41 of this spinning unit back into the operating position, at least the function of the device for interrupting roving feed in the event of a thread break would be retained.

Figure 4:
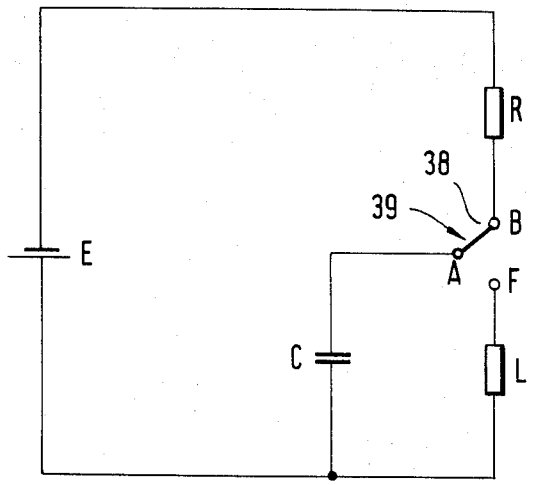
FIGS. 4 and 5 show circuit diagrams of the electric drive for the locking device of the device according to the present invention.
Figure 5:
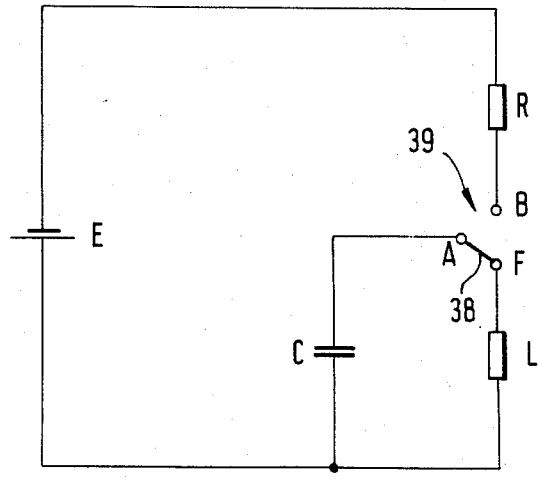

In order to ensure, in a simple manner, that electromagnet 34 is excited only briefly in the event of a thread break, provision is made for broken-end detector 21 to connect the coil of electromagnet 34 to a previously charged capacitor 23 in the event of a thread break, said capacitor then discharging through the coil of electromagnet 34 (FIGS. 4 and 5). The broken-end detector 21 is designed as a toggle switch 39, said switch, when its switching element 38 is in the operating position, connecting contacts A and B of a circuit including a capacitor C, with a power source E (FIG. 4). When a thread break occurs, switch element 38 of broken-end detector 21 (FIG. 5) pivots and connects capacitor C with coil L of electromagnet 34 briefly, so that the discharge current from capacitor C briefly excites electromagnet 34. When broken-end detector 21 of its feeler 16 is returned to the operating position by the yarn (FIG. 4), capacitor C is recharged, so that the device is prepared for another switching process. The circuit of FIGS. 4 and 5 corresponds to that of Ser. No. 311,281.

The operator of this device need only concern himself with returning and locking clamping segment 27, since broken-end detector 21 and its feeler 16 are automatically returned to the operating position by the yarn which is pieced again, in which position capacitor C is charged (FIG. 4). If necessary, the operator must also swing suction tube 42 back into the operating position. Capacitor 23 is equipped with a counter 22, which utilizes the discharge process as a counting pulse and thus marks the occurrence of thread breaks. In addition, provision may also be made to use only one counter 22 for the entire machine, said counter being connected to all capacitors 23 in such fashion that each discharge process of a capacitor 23 triggers a counting pulse, so that the number of thread breaks on the whole machine is counted.

While I have shown and described a single embodiment in accordance with the present invention, it is understood that the same is not limited thereto, but is susceptible of numerous changes and modifications as known to those skilled in the art and I, therefore, do not wish to be limited to the details shown and described herein, but intend to cover all such changes and modifications as are encompassed by the scope of the appended claims.

I claim:

1. The device for interrupting the feed of a roving to a drawing frame of a spinning machine of the type having a plurality of drawing frames, each of the drawing frames including a plurality of upper and lower forward, middle and rear drawing rollers disposed pairwise, comprising:

a clamping segment disposed on one of said drawing rollers adjacent a feed side of the roving, said clamping segment being movable from an operative position permitting driving of said drawing rollers and feed of said roving to an interrupting position interrupting feeding of said roving, broken-end detector means for monitoring breaks in thread spun on the drawing frame, electric means for controlling movement of said clamping segment between said operative and said interrupting positions, control means for controlling said electric means to move the clamping segment to said interrupting position in response to detection of a broken thread by said broken-end detector means, and suction means associated with the drawing rollers on the thread formation side of the drawing frame for collecting rovings present in the respective drawing frame when the roving feed thereto is interrupted, said suction means including a suction device disposed in the vicinity of the forward lower drawing roller and mounted for movement away from said forward lower drawing roller, said suction device cooperating with said broken-end detector means and being lockable in respective operating and nonoperating positions.

2. The device according to claim 1, wherein the suction device includes a suction tube having a swivelably mounted end remote from the drawing rollers, and a connection for a tube connected to a vacuum source.

3. The device according to claim 2, wherein said suction tube is made of an elastically flexible material, and is guided within a guide slot of a guide eye, the width of said guide slot in the lockable positions corresponding to the outside diameter of the suction tube and being otherwise narrower than the outside diameter of said suction tube.

4. The device according to claim 1, 2 or 3, wherein the broken-end detector means is mounted to the end of said suction means, which faces the most downstream drawing roller in the direction of the roving feed.

5. The device according to claim 4, wherein the broken-end detector means is provided with a feeler means operable to engage the thread, said feeler means being made in the form of a pivotably mounted flat plate.

6. The device according to claim 5, wherein said feeler means is of a strikingly bright color for serving as a signal, which can be seen at a distance, indicating that a thread break has occurred.

7. The device according to claim 1, wherein the suction device is lockable in respective operating and non-operating positions by detent-like means.

8. The device according to claim 7, wherein each drawing frame of the spinning machine is provided with a discrete suction device which is displaceable away from the corresponding drawing roller independently of suction devices of adjacent drawing frames.

9. The device according to claim 1, wherein each drawing frame of the spinning machine is provided with a discrete suction device which is displaceable away from the corresponding drawing roller independently of suction devices of adjacent drawing frames.

* * * * *